US007269372B2

(12) United States Patent
Kim et al.

(10) Patent No.: US 7,269,372 B2
(45) Date of Patent: Sep. 11, 2007

(54) OXIDATION CATALYST UNIT, WET-TYPE ELECTROPHOTOGRAPHIC IMAGE FORMING APPARATUS HAVING THE SAME AND METHOD FOR JUDGING CATALYST LIFE SPAN

(75) Inventors: Hyou-jin Kim, Seoul (KR); Kwoang-joe Seorl, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 41 days.

(21) Appl. No.: 11/097,164

(22) Filed: Apr. 4, 2005

(65) Prior Publication Data

US 2005/0276622 A1 Dec. 15, 2005

(30) Foreign Application Priority Data

May 21, 2004 (KR) ..... 10-2004-0036326

(51) Int. Cl.
*G03G 15/06* (2006.01)
*G03G 21/20* (2006.01)

(52) U.S. Cl. ..... 399/93; 399/55

(58) Field of Classification Search ..... 399/91–93, 399/55

See application file for complete search history.

(56) References Cited

U.S. PATENT DOCUMENTS 5,592,815 A * 1/1997 Jelden et al. ..... 60/274

FOREIGN PATENT DOCUMENTS

| | | |
|---|---|---|
| JP | 57-104968 | 6/1982 |
| JP | 03-067277 | 3/1991 |
| JP | 03-094279 | 4/1991 |
| JP | 2000-162933 | 6/2000 |
| KR | 1999-0074129 | 10/1999 |
| KR | 2000-0018735 | 4/2000 |

* cited by examiner

*Primary Examiner*—David M. Gray
*Assistant Examiner*—Ryan Gleitz
(74) *Attorney, Agent, or Firm*—Roylance, Abrams, Berdo & Goodman, LLP

(57) ABSTRACT

An oxidation catalyst unit for judging a life span of an oxidation catalyst and a wet-type electrophotographic image forming apparatus having the oxidation catalyst unit, and a method of judging the life span of the oxidation catalyst. The oxidation catalyst unit includes a duct unit, a fan motor, a heater, an oxidation catalyst filter, and a temperature sensing unit. The temperature sensing unit senses upper and lower atmospheric temperatures of the oxidation catalyst filter. A controller of the wet-type electrophotographic image forming apparatus having the oxidation catalyst unit then compares data on the upper and lower atmosphere temperatures sensed by the temperature sensing unit with input reference data to judge the life span of the oxidation catalyst.

4 Claims, 6 Drawing Sheets

OXIDATION CATALYST UNIT, WET-TYPE ELECTROPHOTOGRAPHIC IMAGE FORMING APPARATUS HAVING THE SAME AND METHOD FOR JUDGING CATALYST LIFE SPAN

CROSS-REFERENCE TO RELATED APPLICATIONS

This application claims the benefit under 35 U.S.C. §119 (a) of Korean Patent Application No. 10-2004-0036326 filed in the Korean Intellectual Property Office on May 21, 2004, the entire disclosure of which is hereby incorporated by reference.

BACKGROUND OF THE INVENTION

1. Field of the Invention

The present invention relates to a wet-type electrophotographic image forming apparatus. More particularly, the present invention relates to an oxidation catalyst unit for judging a life span of an oxidation catalyst catalyzing an oxidation of carrier vapor generated when a printing sheet with a developer passes through a fixing unit, a wet-type electrophotographic image forming apparatus having the same, and a method for judging the life span of the oxidation catalyst.

2. Description of the Related Art

In general, wet-type electrophotographic image forming apparatuses such as laser beam printers irradiate a laser beam onto a photosensitive medium to form an electrostatic latent image, attach a developer to the electrostatic latent image to form a visible image, and transfer the visible image to a predetermined printing medium to output a desired image. Such a wet-type electrophotographic image forming apparatus can obtain a clearer image than a dry-type electrophotographic image forming apparatus using powdered toner and thus, is suitable for color printing.

FIG. 1 schematically illustrates the configuration of a conventional wet-type electrophotographic image forming apparatus.

As shown in FIG. 1, a conventional wet-type electrophotographic image forming apparatus comprises an image forming apparatus body 110, a plurality of photosensitive drums 121, 122, 123 and 124 (121 through 124), a plurality of charging units 131, 132, 133 and 134 (131 through 134), a plurality of exposing units 141, 142, 143 and 144 (141 through 144), a plurality of developing units 151, 152, 153 and 154 (151 through 154), a plurality of first transfer rollers 171, 172, 173 and 174 (171 through 174), a second transfer roller 180, and a fixing unit 190. Electrostatic latent images are formed on the plurality of photosensitive drums 121 through 124. The plurality of charging units 131 through 134 charge the plurality of photosensitive drums 121 through 124 with predetermined potentials, respectively. The plurality of exposing units 141 through 144 irradiate laser beams onto the charged photosensitive drums 121 through 124, respectively. The plurality of developing units 151 through 154 supply the photosensitive drums 121 through 124 with developer, respectively, to form visible images. The plurality of first transfer rollers 171 through 174 transfer the visible images from the photosensitive drums 121 through 124 to a transfer belt 160. The second transfer roller 180 transfers a final image formed on the transfer belt 160 through an overlap of the visible images to a printing sheet P. The fixing unit 190 applies heat and pressure to the printing sheet P to which the final image has been transferred to fuse and fix the final image on the printing sheet P.

The plurality of developing units 151 through 154 store developer of different colors and supply the plurality of photosensitive drums 121 through 124 with the developer of different colors, respectively. Here, the developer contains ink with dispersed toner and a liquid carrier such as Norpar. The Norpar carrier comprises a hydrocarbon-based solvent that is a compound of $C_{10}H_{22}$, $C_{11}H_{24}$, $C_{12}H_{26}$, and $C_{13}H_{28}$. The developer applied to the photosensitive drums 121 through 124 is transferred to the transfer belt 160 to form the visible images. The visible images are overlapped on the transfer belt 160 to form the final image, and then the final image is transferred to the printing sheet P. When the printing sheet P passes through the fixing unit 190, the ink of the developer is fused on the printing sheet P and the liquid carrier of the developer is changed into an inflammable hydrocarbon gas such as methane ($CH_4$) by high heat and discharged to the outside.

The inflammable hydrocarbon gas is classified as a volatile organic compound (VOC). Thus, when the inflammable hydrocarbon gas is discharged, the inflammable hydrocarbon gas pollutes the surroundings and emits an unpleasant smell. To solve this problem, various methods of removing the resulting inflammable hydrocarbon gas are presented.

A conventional inflammable hydrocarbon gas removing method comprises a filtering method of physically removing a gas component using a carbon filter, such an activated carbon. Another conventional inflammable hydrocarbon gas removing method comprises a direct combustion method of burning a gas component at an ignition temperature between approximately 600° C. and 800° C. Still another conventional inflammable hydrocarbon gas removing method comprises an oxidation catalytic method of burning a gas component at a relatively low temperature between approximately 150° C. and 400° C. using a catalyst filter to oxidation-decompose the gas component into water and carbon dioxide.

In the filtering method, the carbon filter does not have an ability to decompose carrier collected therein. Thus, when the carbon filter is saturated with a predetermined amount or more of carrier, the carbon filter must be replaced with new one. In the direct combustion method, high heat is generated, which causes a safety problem.

To solve these problems, an oxidation catalytic method has recently been used as a method of removing carrier vapor of a wet-type electrophotographic image forming apparatus. Such an oxidation process is an exothermic reaction. Thus, when a catalyst filter normally reacts with carrier vapor, an atmospheric temperature of the catalyst filter after the reaction is higher than an atmospheric temperature of the catalyst filter before the reaction. However, in a case where the catalyst filter is exhausted due to heating or contamination and thus fails to normally react with the carrier vapor, the carrier vapor may not be normally decomposed and thus, may be discharged with a smell to the outside, which pollutes the surroundings.

Accordingly, a need exists for a system and method to easily and effectively determine a condition of a oxidation catalyst filter for use in a wet-type electrophotographic image forming apparatus.

SUMMARY OF THE INVENTION

An aspect of the present invention is to solve at least the above problems and disadvantages, and to provide at least the advantages described below. Accordingly, an aspect of the present invention is to provide an oxidation catalyst unit for judging a life span of an oxidation catalyst filter reacting with carrier vapor during an oxidation decomposition of the carrier vapor generated when a printing sheet with a developer passes through a fixing unit. Another aspect of the present invention is to provide a wet-type electrophotographic image forming apparatus having the oxidation catalyst unit, and to provide a method of judging the life span of the oxidation catalyst.

In order to achieve the above-described aspects of the present invention, an oxidation catalyst unit of a wet-type electrophotographic image forming apparatus generating carrier vapor during its operation is provided for filtering, deodorizing, and purifying the carrier vapor through an oxidation reaction using a catalyst. The oxidation catalyst unit comprises a duct unit prepared as an internal and external passage of the wet-type electrophotographic image forming apparatus, an oxidation catalyst filter installed inside the duct unit, a fan motor directing the carrier vapor through the oxidation catalyst filter, a heater installed over the oxidation catalyst filter to heat the carrier vapor, and a temperature sensing unit installed on and beneath the oxidation catalyst filter to sense an atmospheric temperature of the oxidation catalyst filter.

According to another aspect of the present invention, a wet-type electrophotographic image forming apparatus is provided comprising developing units for coating developer on electrostatic latent images formed on photosensitive media to develop the electrostatic latent image as a picture image, a transfer unit for transferring the picture image to a printing medium, a fixing unit for applying heat and pressure to the picture image transferred to the printing medium to fix the picture image as a printed image, an oxidation catalyst unit for oxidizing and purifying carrier vapor generated in the fixing unit through a catalytic reaction, and a controller for receiving data on temperatures sensed by the first and second temperature sensors, comparing the data on the temperatures with input reference data, and transmitting signal information for judging a life span of an oxidation catalyst filter. Here, the oxidation catalyst unit comprises a duct unit installed to be coupled to the fixing unit, the oxidation catalyst filter installed in the duct unit, a fan motor directing the carrier vapor through the oxidation catalyst filter, a heater installed over the oxidation catalyst filter to heat the carrier vapor, and the first and second temperature sensors installed on and beneath the oxidation catalyst filter to sense atmospheric temperatures of the oxidation catalyst filter.

According to still another aspect of the present invention, a method is provided of judging a life span of an oxidation catalyst filter of an oxidation catalyst unit coupled to a fixing unit of a wet-type electrophotographic image forming apparatus, wherein the oxidation catalyst unit is provided to purify carrier vapor generated in the fixing unit through an oxidation catalyst reaction. The method comprises the steps of sensing a temperature $T_{in}$ of atmosphere flowing into the oxidation catalyst filter, sensing a temperature $T_{out}$ of atmosphere flowing out of the oxidation catalyst filter, comparing data on the temperatures $T_{in}$ and $T_{out}$ to calculate a difference $\Delta T$ between the temperatures $T_{in}$ and $T_{out}$, and comparing the difference $\Delta T$ with input reference data.

The method may further comprise a step of calculating an average density $P_a$ of ink fixed on an output printing medium.

The input reference data may be an allowed basic temperature difference $\Delta T_b$ corresponding to the average density $P_a$ of the ink.

The method may further comprise a step of externally displaying an error state outside when the difference $\Delta T$ is less than the allowed basic temperature difference $\Delta T_b$.

The method may further comprise a step of stopping an operation of the wet-type electrophotographic image forming apparatus when the difference $\Delta T$ is less than the allowed basic temperature difference $\Delta T_b$.

BRIEF DESCRIPTION OF THE DRAWINGS

The above aspects and features of the present invention will be more apparent by describing certain embodiments of the present invention with reference to the accompanying drawings, in which.

Throughout the drawings, like reference numerals will be understood to refer to like parts, components and structures.

DETAILED DESCRIPTION OF EXEMPLARY EMBODIMENTS

Figure 1:
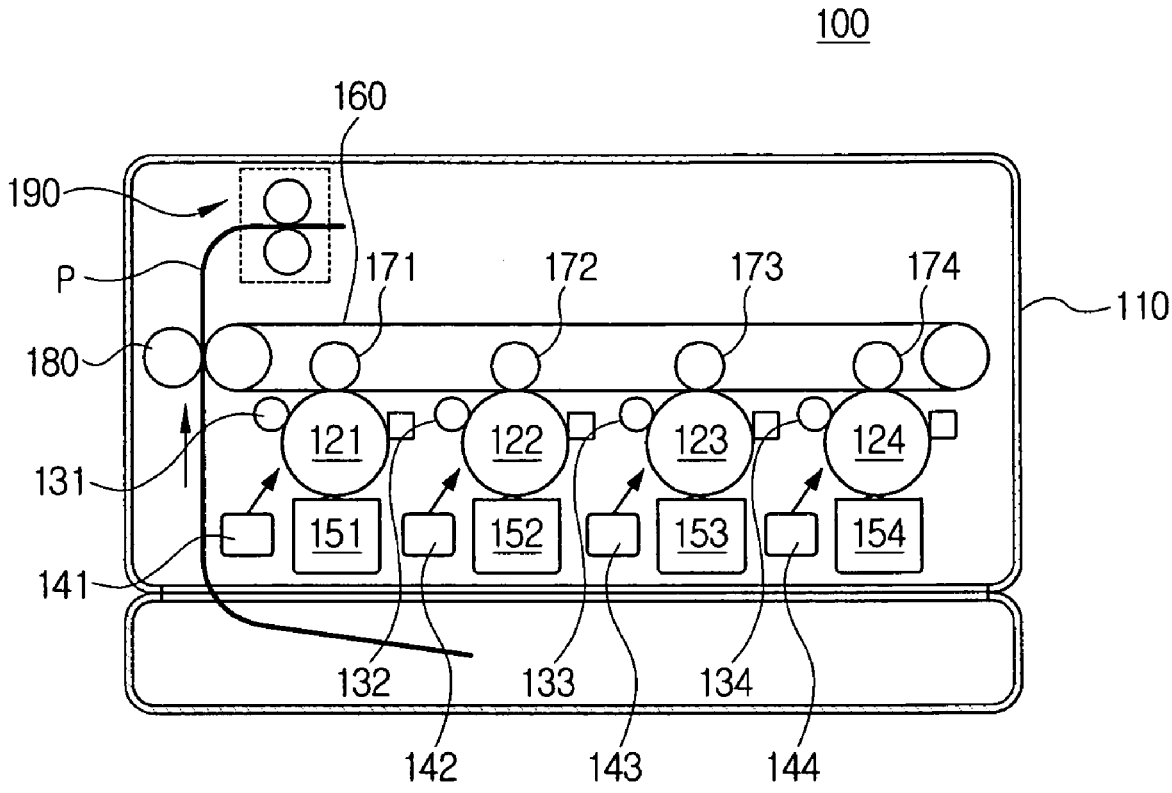
FIG. 1 (PRIOR ART)
FIG. 1 is a schematic view illustrating the configuration of a conventional wet-type electrophotographic image forming apparatus.

An oxidation catalyst unit according to an embodiment of the present invention, and a wet-type electrophotographic image forming apparatus having the oxidation catalyst unit, will now be described in greater detail with reference to the attached drawings.

In the following description, same drawing reference numerals are used for the same elements even in different drawings. The matters defined in the description, such as detailed construction and element descriptions, are provided to assist in a comprehensive understanding of the invention. Also, functions or constructions that are well-known to those skilled in the art are omitted for clarity and conciseness.

Figure 2:
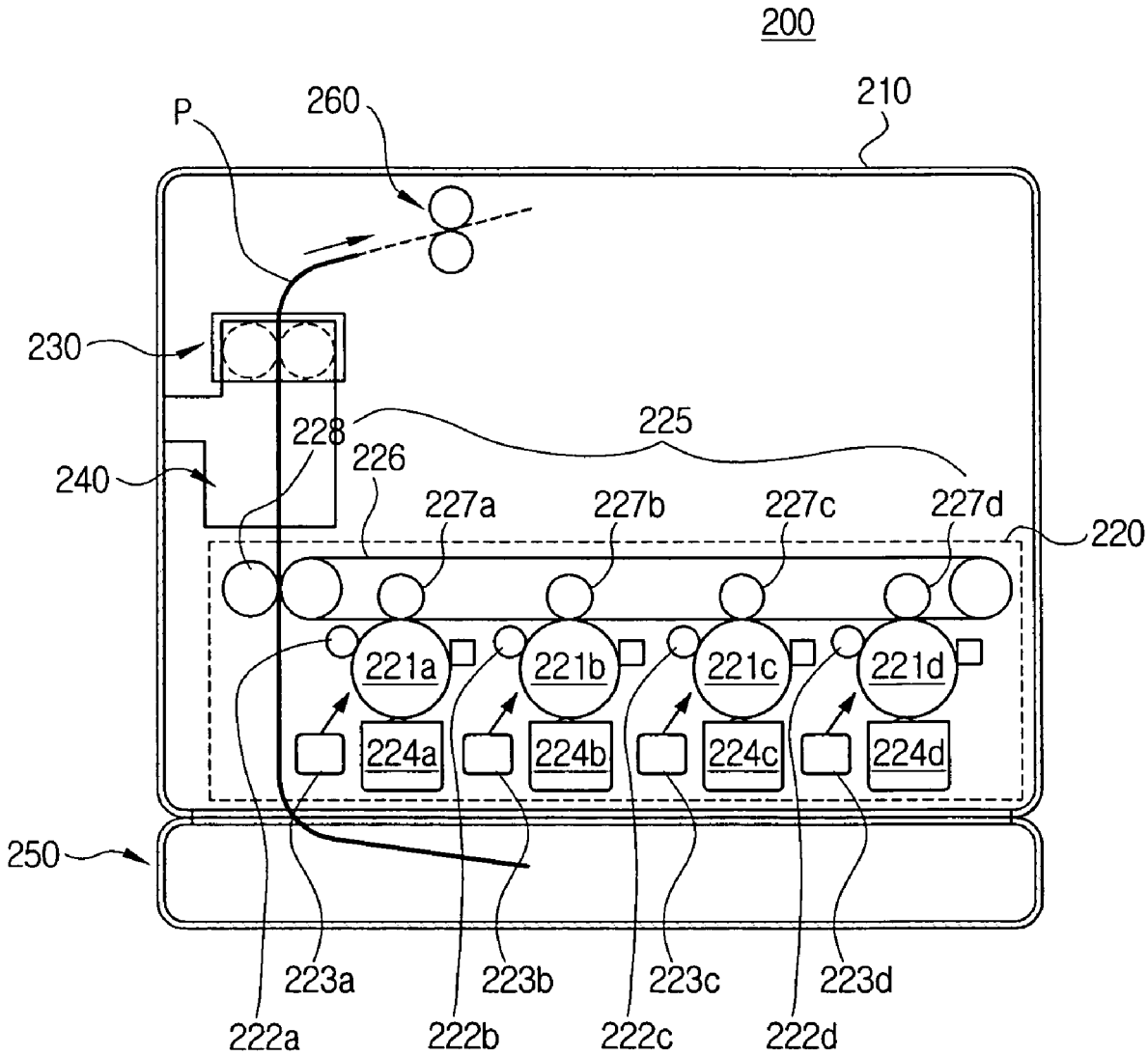
FIG. 2 is a schematic view illustrating the configuration of a wet-type electrophotographic image forming apparatus according to an embodiment of the present invention.
Figure 3:
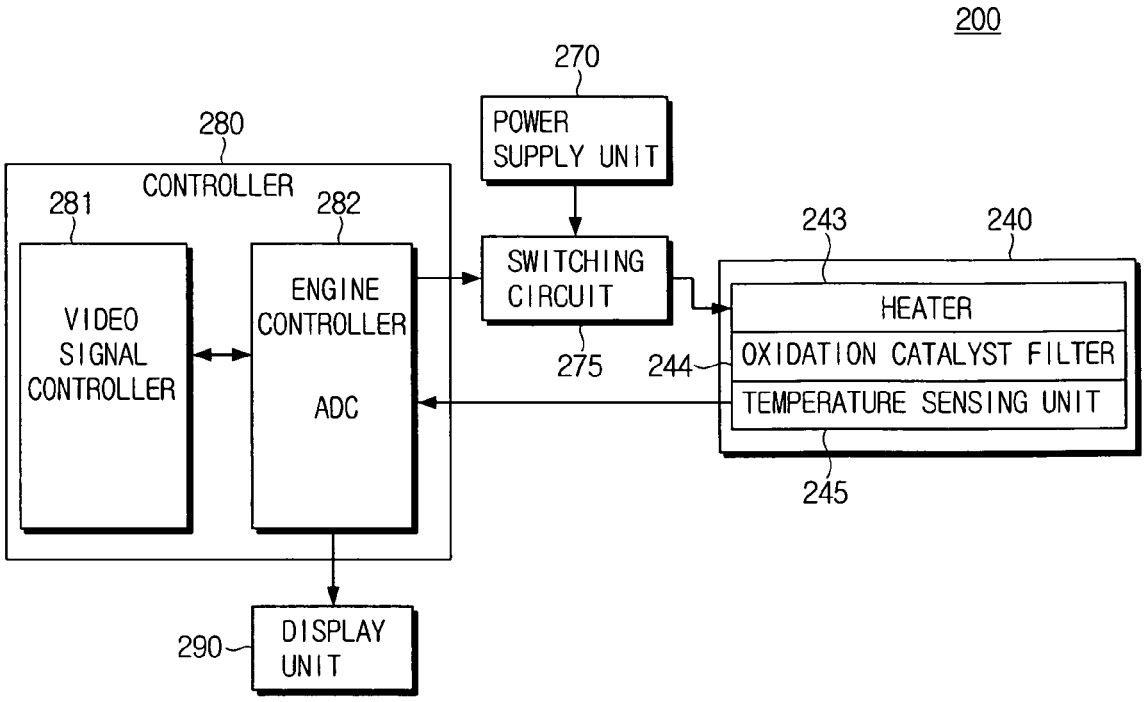
FIG. 3 is a block diagram illustrating the configurations of essential components of the wet-type electrophotographic image forming apparatus shown in FIG. 2.

As shown in FIGS. 2 and 3, a wet-type electrophotographic image forming apparatus 200 according to an embodiment of the present invention comprises an image forming apparatus body 210, a printing engine 220, a fixing unit 230, an oxidation catalyst unit 240, a feeding unit 250, a discharging unit 260, a power supply unit 270, and a controller 280. The image forming apparatus body 210 forms an outer appearance of the wet-type electrophotographic image forming apparatus 200. The printing engine 220 forms visible images using developer, and transfers the visible images to a printing sheet P. The fixing unit 230 fixes the visible images on the printing sheet P. The oxidation catalyst unit 240 is coupled to the fixing unit 230 so as to couple an exterior of the fixing unit 230 to an interior of the image forming apparatus body 210. The feeding unit 250 feeds the printing sheet P to the printing engine 220. The discharging unit 260 discharges the printing sheet P on which printing has been performed.

The printing engine 220 comprises photosensitive drums 221*a*, 221*b*, 221*c* and 221*d* (221*a* through 221*d*) as photosensitive media on which electrostatic latent images are to be formed, charging units 222*a*, 222*b*, 222*c* and 222*d* (222*a* through 222*d*), exposing units 223*a*, 223*b*, 223*c* and 223*d* (223*a* through 223*d*), developing units 224*a*, 224*b*, 224*c* and 224*d*(224*a* through 224*d*), and a transfer unit 225.

The charging units 222*a* through 222*d* charge the surfaces of the photosensitive drums 221*a* through 221*d* with predetermined potentials, respectively, to form the electrostatic latent images on the surfaces of the photosensitive drums 221*a* through 221*d*.

The exposing units 223*a* through 223*d* irradiate laser beams on the surfaces of the photosensitive drums 221*a* through 221*d* charged by the charging units 222*a* through 222*d*. The electrostatic latent images are then formed on the surfaces of the photosensitive drums 221*a* through 221*d* due to a potential difference.

The developing units 224*a* through 224*d* supply the photosensitive drums 221*a* through 221*d* with developer, respectively. The developing units 224*a* through 224*d* store the developer of different colors, respectively, for example, yellow, magenta, cyan, and black, and attach the developer to the electrostatic latent images formed on the surfaces of the photosensitive drums 221*a* through 221*d*. The developer applied to the electrostatic latent images then form the visible images on the surfaces of the photosensitive drums 221*a* through 221*d*. Here, the developer includes ink containing toner and a liquid carrier such as Norpar. The Norpar carrier comprises a hydrocarbon-based solvent that is a compound of $C_{10}H_{22}$, $C_{11}H_{24}$, $C_{12}H_{26}$, and $C_{13}H_{28}$. Thus, when the Norpar is heated, the Norpar is changed into an inflammable hydrocarbon gas such as methane ($CH_4$).

The transfer unit 225 comprises a transfer belt 226 which travels along an endless path in contact with the photosensitive drums 221*a* through 221*d*, a plurality of first transfer rollers 227*a* through 227*d* which transfer the visible images formed on the photosensitive drums 221*a* through 221*d* to the transfer belt 226, and a second transfer roller 228 which transfers a final image formed by overlapping the visible images on the transfer belt 226 to the printing sheet P.

Figure 4:
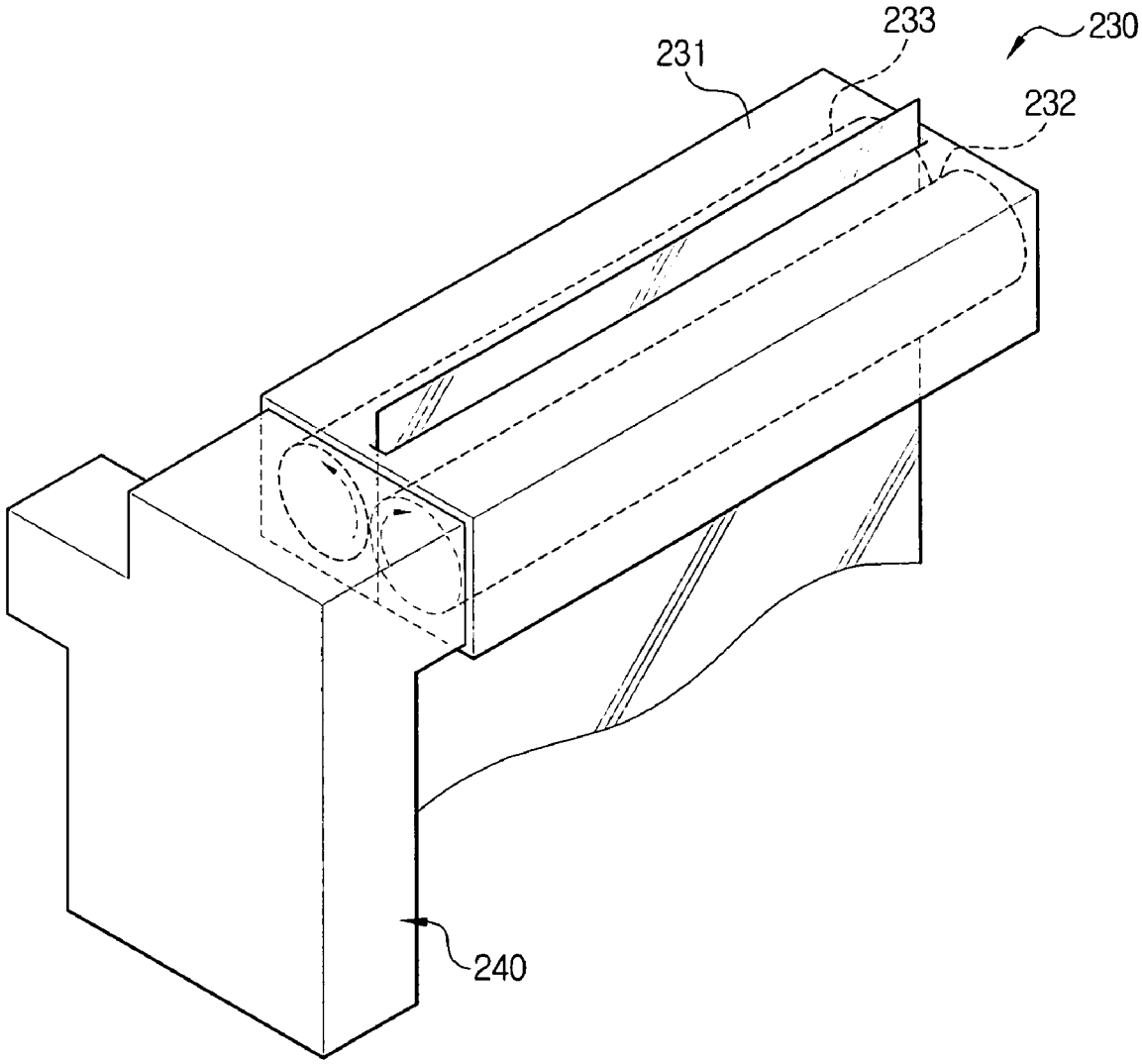
FIG. 4 is a perspective view of a fixing unit shown in FIG. 2.

The fixing unit 230 applies heat and pressure to the printing sheet P to which a color image has been transferred to evaporate the liquid carrier of the developer and fuse and fix the ink of the developer on the printing sheet P. As shown in FIG. 4, the fixing unit 230 comprises a case 231, a heating roller 232 installed inside the case 231 to generate high heat, and a pressing roller 233 installed inside the case 231 to rotate in contact with the heating roller 232. Here, the heating roller 232 comprises a heating unit, such as a heating lamp and an electric heating wire to generate the high heat. Thus, when the transferred color image passes through the fixing unit 230, the liquid carrier such as Norpar is instantaneously evaporated by the high heat. This carrier vapor includes water vapor that the printing sheet P originally contains and Norpar vapor.

Figure 5:
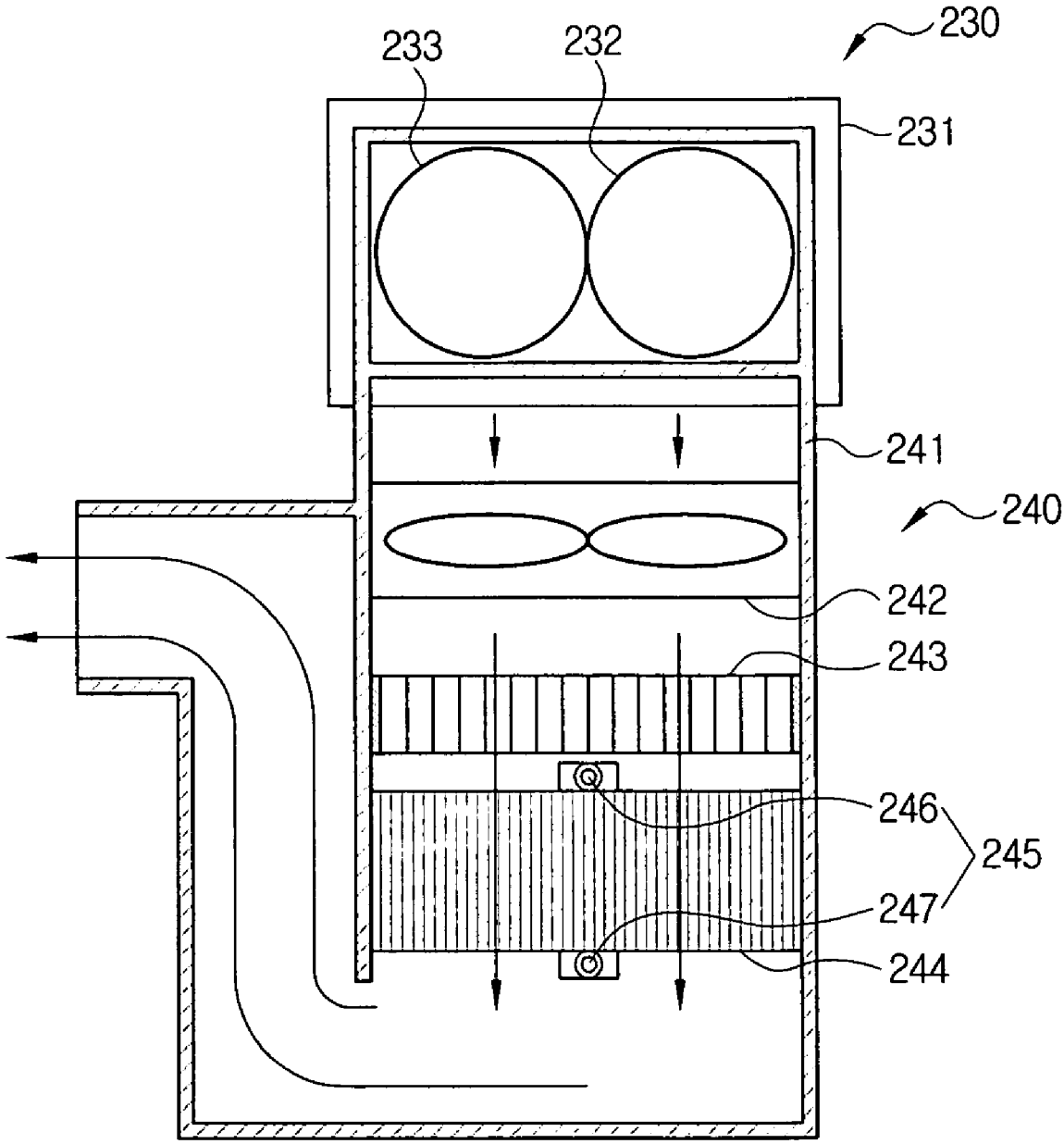
FIG. 5 is a vertical-sectional view of an oxidation catalyst unit shown in FIG. 2.

The oxidation catalyst unit 240 catalyzes an oxidation decomposition reaction of the carrier vapor generated through the evaporation of the developer attached to the printing sheet P in the fixing unit 230. As shown in FIGS. 4 and 5, the oxidation catalyst unit 240 comprises a duct unit 241, a fan motor 242, a heater 243, an oxidation catalyst filter 244, and a temperature sensing unit 245.

The duct unit 241 comprises an end coupled to the case 231 of the fixing unit 230 so as to guide the carrier vapor generated inside the case 231 to the outside of the image forming apparatus body 210, as shown in FIG. 2.

The fan motor 242 is installed inside the duct unit 241 and draws the carrier vapor from the fixing unit 230 to allow the carrier vapor to flow into the oxidation catalyst unit 240. In an exemplary embodiment, the fan motor 242 is installed inside the duct unit 241. However, since the fan motor 242 directs the carrier vapor generated in the fixing unit 230 to flow in a predetermined direction, that is, into the oxidation catalyst unit 240, the position of the fan motor 242 is not necessarily limited to the inside of the duct unit 241.

The heater 243 increases a temperature of the carrier vapor directed by the fan motor 242 to an activation temperature, for example, about 200° C. Here, the activation temperature may vary with the kind of catalyst or the like, that is being used.

The oxidation catalyst filter 244 is coated with an oxidation catalyst such as platinum (Pt), palladium (Pd), or the like, and is installed under or behind the heater 243. The oxidation catalyst filter 244 is activated at a temperature of about 200° C. to catalyze the oxidation decomposition reaction by which the carrier vapor as an inflammable hydrocarbon gas is decomposed into water and carbon dioxide. Here, an oxidation process generated when passing through the oxidation catalyst filter 244 is an exothermic reaction. Thus, when the oxidation catalyst normally reacts, an atmospheric temperature measured when the carrier vapor passes through the oxidation catalyst filter 244, that is, a lower atmospheric temperature of the oxidation catalyst filter 244, is higher than an atmospheric temperature measured when the carrier vapor flows into the oxidation catalyst filter 244, that is, an upper atmospheric temperature of the oxidation catalyst filter 244.

The temperature sensing unit 245 detects the upper and lower atmospheric temperatures of the oxidation catalyst filter 244 as described above, and comprises a first temperature sensor 246 installed on the oxidation catalyst filter 244 and a second temperature sensor 247 installed beneath the oxidation catalyst filter 244. The first temperature sensor 246 senses an upper atmospheric temperature $T_{in}$ of the oxidation catalyst filter 244 when the carrier vapor flows into the oxidation catalyst filter 244, and the second temperature sensor 247 senses a lower atmospheric temperature $T_{out}$ of the oxidation catalyst filter 244 when the carrier vapor passes through the oxidation catalyst filter 244. The temperature sensing unit 245 may comprise any means for sensing an atmospheric temperature of the oxidation catalyst filter 244. However, the temperature sensing unit 245 generally comprises a heat sensor such as a thermistor. The configuration of the heat sensor such as the thermistor is well known to those skilled in the art and thus, will not be described herein. The temperature sensing unit 245 may be installed in contact with the oxidation catalyst filter 244, or may be installed on or beneath the oxidation catalyst filter 244 to sense a temperature of the oxidation catalyst filter 244 and to exchange information with an engine controller 282 of FIG. 3 that is described in greater detail below.

Referring to FIG. 3, the power supply unit 270 supplies the heater 243 of the oxidation catalyst unit 240 with power so as to generate a high temperature. A switching circuit 275 is installed between the power supply unit 270 and the heater 243 to switch the power supply unit 270 on and off so as to control the power supplied from the power supply unit 270 to the heater 243.

Referring to FIG. 3, the controller 280 comprises the engine controller 282 which controls the overall operations of the wet-type electrophotographic image forming apparatus, and a video signal controller 281 which controls an image to be printed. The video signal controller 281 generates the image to be printed on the printing sheet P and transmits data on the image to the engine controller 282.

With the generation of the image to be printed, the video signal controller 281 also calculates an amount of ink required for printing the generated image on the printing sheet P and transmits data on the amount of ink to the engine controller 282. The engine controller 282 reads the data on the image transmitted from the video signal controller 281 to control an overall process of printing of the image on the printing sheet P. The engine controller 282 detects various errors occurring during printing by various sensors (not shown) installed inside the wet-type electrophotographic image forming apparatus 200 and displays the various errors via a display unit 290.

The engine controller 282 also calculates a value of the temperature data transmitted from the temperature sensing unit 245, that is, a difference ΔT between the upper and lower atmospheric temperatures $T_{in}$ and $T_{out}$ of the oxidation catalyst filter 244, via an analog-to-digital converter (ADC), compares the difference ΔT with preset reference data to judge the life span of the oxidation catalyst, and displays any error or message occurring from the comparison result via the display unit 290. The engine controller 282 judges the life span of the oxidation catalyst using the data on the amount of ink transmitted from the video signal controller 281. This judgment operation is described in greater detail below.

The engine controller 282 also controls the switching circuit 275 using the temperature data of the oxidation catalyst filter 244 transmitted from the temperature sensing unit 245 to switch on/off the power supply unit 270 so as to control the power supplied to the heater 243. That is, when a temperature of the oxidation catalyst filter 244 is equal to or greater than a preset predetermined maximum temperature $T_m$, the engine controller 282 stops the operation of the heater 243 for safety.

An oxidation catalyst unit according to an embodiment of the present invention, an operation of a wet-type electrophotographic image forming apparatus having the oxidation catalyst unit, and a method of judging a life span of an oxidation catalyst of the oxidation catalyst unit, will now be described in greater detail.

When a printing command is applied to the wet-type electrophotographic image forming apparatus 200, the video signal controller 281 generates the image to be printed and transmits the image data to the engine controller 282. With the generation of the image, the video signal controller 281 transmits the data on the amount of ink required for printing the image to the engine controller 282. The engine controller 282 then controls the following printing process.

As shown in FIG. 2, the exposing units 223*a* through 223*d* irradiate the laser beams onto the surfaces of the photosensitive drums 221*a* through 221*d* charged with the predetermined potentials by the charging units 222*a* through 222*d*. The predetermined potentials charged on the surfaces of the photosensitive drums 221*a* through 221*d* onto which the laser beams have been irradiated are changed, so as to form the electrostatic latent images. The developing units 224*a* through 224*d* apply the yellow, magenta, cyan, and black color developer to the electrostatic latent images formed on the photosensitive drums 221*a* through 221*d*, respectively, to form the visible images. The first transfer rollers 227*a* through 227*d* sequentially transfer the visible images of the four colors to the transfer belt 226 so as to form the color image on the transfer belt 226 by overlapping the developer of the four colors. The feeding unit 250 transfers the printing sheet P to the transfer belt 226 during the image forming processes. When the printing sheet P is transferred between the transfer belt 226 and the second transfer roller 228, the second transfer roller 228 transfers the color image formed on the transfer belt 226 to the printing sheet P, and then the printing sheet P advances toward the fixing unit 230.

The printing sheet P transferred to the fixing unit 230 passes between the heating roller 232 and the pressing roller 233 as shown in FIG. 4, comes out of the fixing unit 230, and is discharged to the outside of the image forming apparatus body 210 through the discharging unit 260. Here, when the printing sheet P passes between the heating roller 232 and the pressing roller 233, the liquid carrier of the developer transferred onto the printing sheet P is evaporated by the high heat generated from the heating roller 232, and the ink of the developer is fused and fixed on the printing sheet P.

Figure 6:
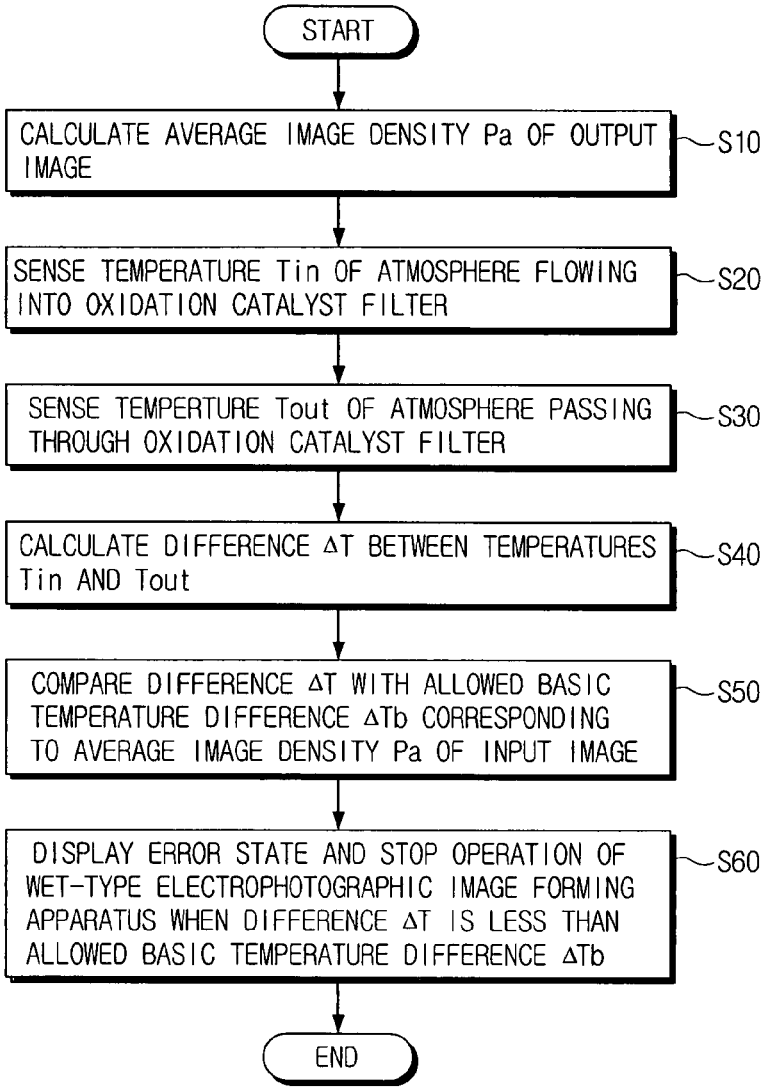
FIG. 6 is a flowchart illustrating a method of judging a life span of an oxidation catalyst according to an embodiment of the present invention.

The operation of the oxidation catalyst unit 240 and the method of judging the life span of the oxidation catalyst will now be described in greater detail with reference to FIGS. 4 through 6. FIG. 6 is a flowchart illustrating a method of judging a life span of an oxidation catalyst according to an embodiment of the present invention. In step S10, the engine controller 282 calculates an average image density $P_a$ of an output image based on the data on the image transmitted from the video signal controller 281 before the above-described printing process is performed.

The carrier vapor generated inside the case 231 is discharged to the outside of the case 231 via the fan motor 242 and then passes through the heater 243. The carrier vapor heated by the heater 243 passes through the oxidation catalyst filter 244. In step S20, the first temperature sensor 246 of the temperature sensing unit 245 senses the upper atmospheric temperature $T_{in}$ of the oxidation catalyst filter 244 when the carrier vapor starts passing through the oxidation catalyst filter 244. In step S30, the second temperature sensor 247 senses the lower atmospheric temperature $T_{out}$ of the oxidation catalyst filter 244 after the carrier vapor causes the oxidation reaction while passing through the oxidation catalyst filter 244. In step S40, the engine controller 282 calculates the difference ΔT between the upper and lower atmospheric temperatures $T_{in}$ and $T_{out}$ using information transmitted from the temperature sensing unit 245. The difference ΔT is compared with the preset reference data to judge whether the oxidation catalyst is abnormal. Table 1 below shows an exemplary preset reference data set obtained by performing a test of an exemplary embodiment of the present invention over a long period of time. Prior to the description of the preset reference data of Table 1, it can be noted that the values of the present test were obtained while using a platinum catalyst and therefore, may obviously vary depending on setting standards such as the kind of catalyst used and differences in activation temperatures.

TABLE 1

| Basic Image Density ($P_b$) | Less than 5% | 5%~less than 20% | 20%~less than 100% | 100% and more |
|---|---|---|---|---|
| Allowable temperature difference $\Delta T_b$ when printing is performed on less than 5 printing sheets | X | X | 5° C. | 10° C. |

TABLE 1-continued

| Basic Image Density ($P_b$) | Less than 5% | 5%~less than 20% | 20%~less than 100% | 100% and more |
|---|---|---|---|---|
| Allowable temperature difference $\Delta T_b$ when printing is performed on 5 or more printing sheets | X | 5° C. | 10° C. | 20° C. |

The top row in Table 1 shows a basic image density $P_b$ of an output image expressed as a percentage in each predetermined section. In this example, the basic image density $P_b$ is 100% when the image covers the whole portion of a reference printing sheet. Thus, in a case wherein a small amount of ink is required for performing printing on one surface of the reference printing sheet, the basic image density $P_b$ is low. In a case wherein a large amount of ink is required, in particular, in a case wherein an image picture or the like is printed, the basic image density $P_b$ is high. In the above test of an exemplary embodiment, a number of reference printing sheets is "5", however, the number may vary with changes to any of several test parameters. A value of the basic image density $P_b$ may also vary with changes to any of several test parameters. The reference printing sheet may be designated beforehand by a controller. However, in the above test of an exemplary embodiment, the reference printing sheet is basically set to A4.

A vertical column in Table 1 shows an allowed basic temperature difference $\Delta T_b$ between the upper and lower atmospheric temperatures $T_{in}$ and $T_{out}$ corresponding to each basic image density $P_b$ based on 5 reference printing sheets. That is, when the difference $\Delta T$ between the upper and lower atmospheric temperatures $T_{in}$ and $T_{out}$ is less than the allowed basic temperature difference $\Delta T_b$, the catalyst is judged to be abnormal. When the difference $\Delta T$ between the upper and lower atmospheric temperatures $T_{in}$ and $T_{out}$ is equal to or more than the allowed basic temperature difference $\Delta T_b$, the catalyst is judged to be normal. Also, when the allowed basic temperature difference $\Delta T_b$ is X, it designates that the carrier vapor of the catalyst can be treated without a problem. That is, if the number of printing sheet is small or an amount of carrier vapor to be oxidized is small, an error risk is slight.

As shown in row 3, column 4 of Table 1, when printing is performed based on 5 or more printing sheets, and the average image density $P_a$ of the printed image is within an range of the basic image density $P_b$ between 20% and 100%, and further if the difference $\Delta T$ between the upper and lower atmospheric temperatures $T_{in}$ and $T_{out}$ is equal to or more than 10° C., the catalyst performs its function without being abnormal. However, when the difference $\Delta T$ between the upper and lower atmospheric temperatures $T_{in}$ and $T_{out}$ is less than 10° C., the catalyst is determined to be abnormal, such as occurring when the catalyst is exhausted, and thus must be replaced. Therefore, with reference to row 3, column 4 of Table 1, when printing is performed on 10 printing sheets, and the average image density $P_a$ is 50%, and further if the difference $\Delta T$ between the upper and lower atmospheric temperatures $T_{in}$ and $T_{out}$ is 7° C., the value difference $\Delta T$ of 7° C. is smaller than the allowed basic temperature difference $\Delta T_b$ of 10° C. within the range of the basic image density $P_b$ between 20% and 100%. Thus, the catalyst has exhausted its life span and thus, must be replaced. Here, the value of the average image density $P_a$ is automatically calculated as a value of an image density generated whenever printing is performed on each of 10 printing sheets. Also, the difference $\Delta T$ between the upper and lower atmospheric temperatures $T_{in}$ and $T_{out}$ indicates a difference between the upper and lower atmospheric temperatures $T_{in}$ and $T_{out}$ generated after printing is performed on the tenth printing sheet.

In the example shown in Table 1, as an average density of an image to be output is increased, a value of the allowed basic temperature difference $\Delta T_b$ becomes larger. This is because an increase in the density of an image to be output indicates an increase in an amount of developer required for printing, and the increase in the amount of developer indicates an increase in carrier vapor generated in a fixing unit.

As described above, an oxidation reaction is an exothermic reaction. Thus, when a catalyst normally reacts, a temperature of the catalyst increases after the oxidation reaction. As an amount of the carrier vapor increases, an amount of the catalyst to react with the carrier vapor increases in proportion to the amount of the carrier vapor. As a result, the difference $\Delta T$ between the upper and lower atmospheric temperatures $T_{in}$ and $T_{out}$ increases with the increases in the amount of the catalyst. Accordingly, when the difference $\Delta T$ between the upper and lower atmospheric temperatures $T_{in}$ and $T_{out}$ is smaller than the allowed basic temperature difference $\Delta T_b$, the catalyst does not perform its function. This means that an ability of the catalyst to oxidation-decompose the carrier vapor is degraded.

Returning to FIG. 6, in step S50, the engine controller 282 compares the difference $\Delta T$ between the upper and lower atmospheric temperatures $T_{in}$ and $T_{out}$ obtained from the temperature sensing unit 245 with the allowed basic temperature difference $\Delta T_b$ corresponding to the average image density $P_a$ of each image with respect to the basic number of printing sheets obtained from the video signal controller 281 as shown in Table 1. If it is judged in step S50 that an error occurs, that is, that the difference $\Delta T$ between the upper and lower atmospheric temperatures $T_{in}$ and $T_{out}$ is less than the allowed basic temperature difference $\Delta T_b$, the engine controller 282 stops the operation of the wet-type electrophotographic image forming apparatus 200 and displays the error state via the display unit 290 in step S60.

The engine controller 282 may further control the temperature of the oxidation catalyst filter 244 using the temperature data obtained from the temperature sensing unit 245 by controlling the power supplied to the heater 243. That is, the engine controller 282 receives data on the temperature of the oxidation catalyst filter 244 from the temperature sensing unit 245 to determine when to switch on/off the switching circuit 275. A minimum activation temperature of the oxidation catalyst filter 244 varies with the kind of catalyst used, but is generally about 190° C. If the minimum activation temperature of the oxidation catalyst filter 244 increases to about 230° C., the oxidation catalyst filter 244 may be broken down and result in safety problems. That is, when an oxidation decomposition reaction of the carrier vapor is performed in a printing mode, reaction heat of about 150° C. is generated in the oxidation catalyst unit 240. Thus, when the upper atmospheric temperature $T_{in}$ of the oxidation catalyst filter 244 increases to the preset maximum temperature $T_m$ or more during printing, the engine controller 282 cuts off the power supplied to the heater 243 so as not to overheat the oxidation catalyst unit 240, particularly, the oxidation catalyst filter 244. Here, the temperature information may further include and use the lower atmospheric temperature $T_{out}$.

Since the fan motor 242 continues operating, the carrier vapor having passed through the oxidation catalyst filter 244 is oxidation-decomposed into water and carbon dioxide, and discharged to the outside of the duct unit 241.

As described above, according to the present invention, upper and lower atmospheric temperatures of an oxidation catalyst filter can be sensed and a difference between the upper and lower atmospheric temperatures can be obtained to judge a life span of a catalyst. When an error is determined by observing the difference between the upper and lower atmospheric temperatures, the error state can be displayed to an outside user. Thus, harmful carrier vapor can be purified and then discharged with consistency.

The foregoing embodiments and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A method of determining a condition of an oxidation catalyst filter of an oxidation catalyst unit that is coupled to a fixing unit of a wet-type electrophotographic image forming apparatus to purify carrier vapor generated in the fixing unit through an oxidation catalyst reaction, the method comprising:

sensing a temperature $T_{in}$ of atmosphere flowing into the oxidation catalyst filter;

sensing a temperature $T_{out}$ of atmosphere flowing out of the oxidation catalyst filter;

comparing data on the temperatures $T_{in}$ and $T_{out}$ to calculate a difference $\Delta T$ between the temperatures $T_{in}$ and $T_{out}$;

comparing the difference $\Delta T$ with input reference data to determine a condition of the oxidation catalyst filter;

calculating an average density $P_a$ of ink fixed on an output printing medium of the wet-type electrophotographic image forming apparatus, wherein the input reference data comprises an allowed basic temperature difference $\Delta T_b$ corresponding to the average density $P_a$ of the ink; and displaying an error state when the difference $\Delta T$ is less than the allowed basic temperature difference $\Delta T_b$.

2. The method of claim 1, further comprising a step of stopping an operation of the wet-type electrophotographic image forming apparatus when the difference $\Delta T$ is less than the allowed basic temperature difference $\Delta T_b$.

3. A method of determining a condition of an oxidation catalyst filter of an oxidation catalyst unit that is coupled to a fixing unit of a wet-type electrophotographic image forming apparatus to purify carrier vapor generated in the fixing unit through an oxidation catalyst reaction, the method comprising:

sensing a temperature $T_{in}$ of atmosphere flowing into the oxidation catalyst filter;

sensing a temperature $T_{out}$ of atmosphere flowing out of the oxidation catalyst filter;

comparing data on the temperatures $T_{in}$ and $T_{out}$ to calculate a difference $\Delta T$ between the temperatures $T_{in}$ and $T_{out}$;

comparing the difference $\Delta T$ with input reference data to determine a condition of the oxidation catalyst filter;

calculating an average density $P_a$ of ink fixed on an output printing medium of the wet-type electrophotographic image forming apparatus, wherein the input reference data comprises an allowed basic temperature difference $\Delta T_b$ corresponding to the average density $P_a$ of the ink; and stopping an operation of the wet-type electrophotographic image forming apparatus when the difference $\Delta T$ is less than the allowed basic temperature difference $\Delta T_b$.

4. The method of claim 3, further comprising a step of displaying an error state when the difference $\Delta T$ is less than the allowed basic temperature difference $\Delta T_b$.

* * * * *